US010920500B1

(12) United States Patent
Dunbar

(10) Patent No.: US 10,920,500 B1
(45) Date of Patent: Feb. 16, 2021

(54) ADJUSTABLE DOWNHOLE NOZZLE

(71) Applicant: Halliburton Energy Services, Inc., Houston, TX (US)

(72) Inventor: Bradley David Dunbar, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/599,187

(22) Filed: Oct. 11, 2019

(51) Int. Cl.

| | |
|---|---|
| ***E21B 10/61*** | (2006.01) |
| ***E21B 10/62*** | (2006.01) |
| ***B05B 15/652*** | (2018.01) |
| *E21B 10/18* | (2006.01) |

(52) U.S. Cl.
CPC ..... *E21B 10/61* (2013.01); *B05B 15/652* (2018.02); *E21B 10/62* (2013.01); *E21B 10/18* (2013.01)

(58) Field of Classification Search
CPC ..... E21B 10/60; E21B 10/61; E21B 10/38; E21B 10/18
See application file for complete search history.

(56) References Cited

U.S. PATENT DOCUMENTS

| | | | | |
|---|---|---|---|---|
| 4,094,492 | A | 6/1978 | Beeman et al. | |
| 4,533,005 | A | 8/1985 | Morris | |
| 6,227,316 | B1 | 5/2001 | Rohde | |
| 8,910,920 | B1 | 12/2014 | Daniels | |
| 9,309,726 | B2 | 4/2016 | Tahoun et al. | |
| 2015/0136489 | A1* | 5/2015 | Tahoun | E21B 10/18 175/48 |

* cited by examiner

*Primary Examiner* — Kristyn A Hall
(74) *Attorney, Agent, or Firm* — Gilliam IP PLLC

(57) ABSTRACT

A drill bit nozzle assembly and drill bit including the same may include a conical or frustum contoured nozzle body. The nozzle body includes multiple movable closure elements circumferentially arranged to form an inlet orifice, a variable diameter outlet orifice, and a fluid a passage to transport fluid from the inlet orifice to the variable diameter outlet orifice. The nozzle assembly may further include an actuator configured to vary a diameter of the variable diameter outlet orifice based on a change of position of the movable closure elements.

18 Claims, 9 Drawing Sheets

ADJUSTABLE DOWNHOLE NOZZLE

BACKGROUND

The disclosure generally relates to the field of downhole hydraulics implemented by drill bits and more particularly to drill bit hydraulic nozzles.

Rotary drill bits, including fixed cutter and roller cone types, generally comprise a bit body having a fluid cavity. One or more drilling fluid flow ports may extend from the fluid cavity to respective outflow nozzles formed at exterior portions of the bit body. Drilling fluid may be pumped through a drill string to which the drill bit is attached, into the fluid cavity formed within the bit body, and out through the drilling fluid flow ports and nozzles.

In some cases, the nozzles of a drill bit can include an inlet portion and outlet portion forming the exit orifices through which drilling fluid is expelled from the bit body during drilling to facilitate drilling efficiency such as by clearing cuttings debris at the bit face and cooling drill bit components. The nozzles are individually and collectively configured in terms of dimension, orientation, and positioning on the bit body to direct the one or more corresponding exiting drilling fluid streams in a specified manner individually and as a collective pattern. In addition to supporting drill bit cutting penetration, the nozzles may be configured to sufficiently accelerate exiting drilling fluid toward adjacent formation materials to abrade or otherwise erode materials from the borehole edge to optimize borehole formation.

BRIEF DESCRIPTION OF THE DRAWINGS

Aspects of the disclosure may be better understood by referencing the accompanying drawings.

DESCRIPTION

The description that follows includes example systems, methods, techniques, and program flows that characterize embodiments of the disclosure. However, it is understood that this disclosure may be practiced without one or more of these specific details. In other instances, well-known instruction instances, protocols, structures and techniques have not been shown in detail in order not to obfuscate the description.

Overview

The disclosure uses "drill bit" and "bit" in reference to various types of roller cone drill bits, rotary cone drill bits, fixed cutter drill bits, drag bits, matrix drill bits, and other types of bits incorporated into drill strings for drilling subterranean boreholes. Drill bits and associated nozzles incorporating aspects of the present disclosure may have many different designs and configurations. The terms "cutter" and "cutting element" may be used in reference to various types of cutters, inserts, milled teeth, gauge cutters, impact arrestors and/or welded compacts satisfactory for use with a wide variety of drill bits.

As used herein "drilling fluid" is used in reference to various fluids and mixtures of fluids and suspended solids associated with rotary well drilling techniques. A wide variety of chemical compounds may be added to a drilling fluid as appropriate for associated downhole drilling conditions and formation materials. For some special drilling techniques and downhole formations, air or other suitable gases may be used as a drilling fluid.

Embodiments disclosed herein include a drilling fluid nozzle assembly and systems and methods for implementing a drilling fluid nozzle that are configured to control nozzle flow characteristics to optimize hydraulics dynamics during drilling operations. A drilling system may be configured to determine drilling operation information, such as drill bit type and current rate of penetration (ROP), and to apply the information to control flow from the bit nozzles. The bit nozzles may be adjusted to achieve a fluid pressure and/or fluid exit velocity based, at least in part, on the drilling metrics and downhole conditions to optimize drilling efficiency.

Example Illustrations

Figure 1:
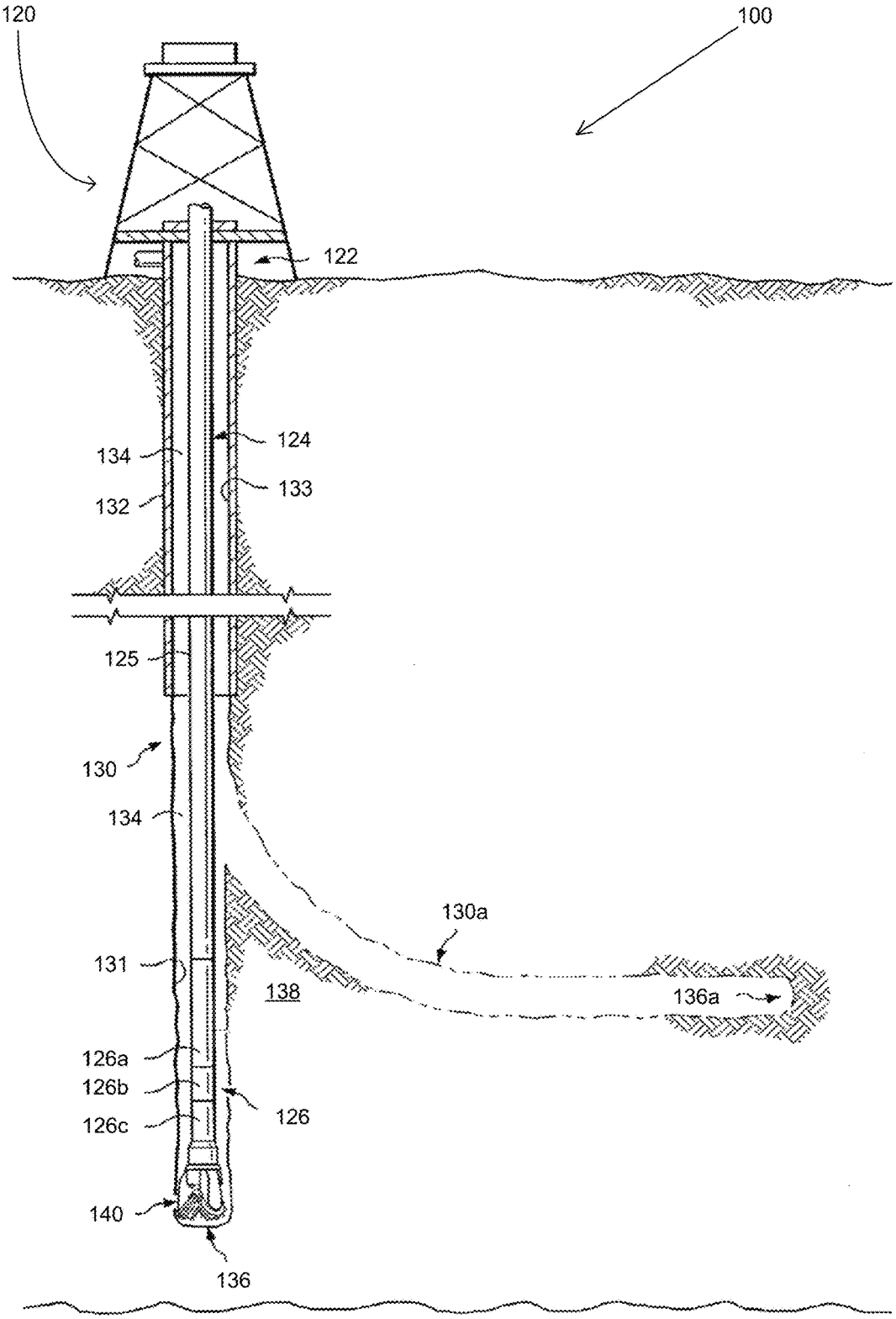
FIG. 1 is an elevation view depicting a wellbore drilling system in accordance with some embodiments.
Figure 2A:
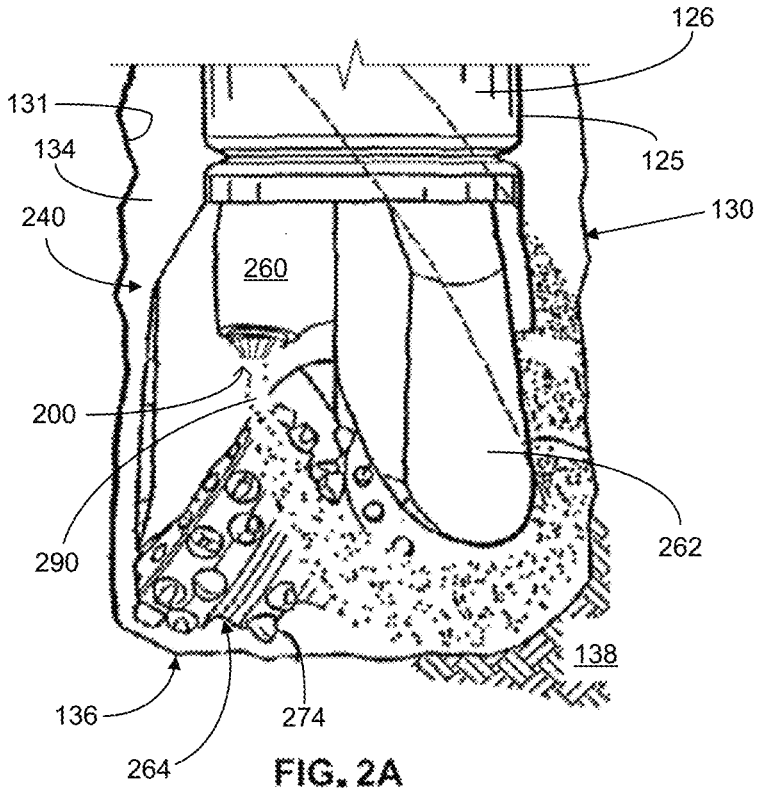
FIG. 2A is a perspective drawing of a roller-cone type drill bit configured in accordance with some embodiments and that may be incorporated in the drill string depicted in FIG. 1.

FIG. 1 is an elevation view of a wellbore drilling system 100 in accordance with some embodiments. Wellbore drilling system 100 includes a drilling rig 120 located at well surface 122 and configured to control drilling components within a drill string 124. A drill bit 140 is coupled to the end of drill string 124. Drill bit 140 may be configured similarly to a roller-cone type drill bit 240 shown in FIGS. 2A and 2B, or similarly to a fixed cutter type drill bit 340 such as shown in FIGS. 3A and 3B. Drill string 124 may be formed from sections or joints of generally hollow, tubular drill pipe. Drill string 124 further includes a bottom hole assembly (BHA) 126 formed from a variety of components. For example, components 126*a*, 126*b* and 126*c* may be selected from the group consisting of, but not limited to, drill collars, rotary steering tools, directional drilling tools and/or downhole drilling motors. The number of components such as drill collars and different types of components in a BHA will depend on anticipated downhole drilling conditions and the type of wellbore which will be formed by drill string 124 and drill bit 140.

Drill bit 140 is coupled to BHA 126 at the distal end of drill string 124. Drill string 124 is driven in some embodiments by a top drive within drilling rig 120 to form various types of wellbores. For example, a wellbore 130 may extend downward from well surface 122 in a generally vertical orientation. In other examples, a horizontal wellbore 130*a*, shown in dotted lines, may be formed using drill string 124 using various directional drilling techniques.

Wellbore 130 may be defined in part by a casing string 132 extending from well surface 122 to a selected downhole location. As shown in FIGS. 1, 2A and 3A, remaining portions of wellbore 130 may be described as "open hole" (no casing). Various types of drilling fluid may be pumped from well surface 122 through drill string 124 into and through drill bit 140. The drilling fluid may be circulated back to well surface 122 through an annulus 134 between an outside surface 125 of drill string 124 and inside surface 131 of wellbore 130 and between an outside surface 125 of drill string 124 and an inside surface 133 of casing string 132.

The type of drilling fluid used while drilling may be selected based on design characteristics of drill bit 140 and/or characteristics of anticipated downhole formations and hydrocarbons or other fluids produced by one or more downhole formations adjacent to wellbore 130 and/or wellbore 130*a*. Drilling fluids are used to move formation cuttings and other downhole debris from wellbore 130 and/or wellbore 130*a* to well surface 122 and to otherwise facilitate drilling. Formation cuttings may be generated by drill bit 140 engaging an end face 136 of wellbore 130. Formation cuttings may also be generated by drill bit 140 engaging an end face 136*a* of horizontal wellbore 130*a*.

Drilling fluids are also used to clean, cool and lubricate cutting elements, cutting structures and other components associated with drill bit 140. Furthermore, drilling fluids may assist in breaking away, abrading and/or eroding adjacent portions of downhole rock strata such as formation material 138 depicted in FIGS. 1, 2A and 3A. Drilling fluids are also used for well control by maintaining desired fluid pressure equilibrium within wellbore 130 and/or wellbore 130*a*. The weight or density of drilling fluid is generally selected to prevent undesired fluid flow from an adjacent downhole formation into a wellbore and also to prevent undesired flow of the drilling fluid from the wellbore into the downhole formations. Drilling fluids may also provide chemical stabilization for formation materials adjacent to a wellbore and may prevent or minimize corrosion of a drill string, BHA and/or attached drill bit.

Figure 2B:
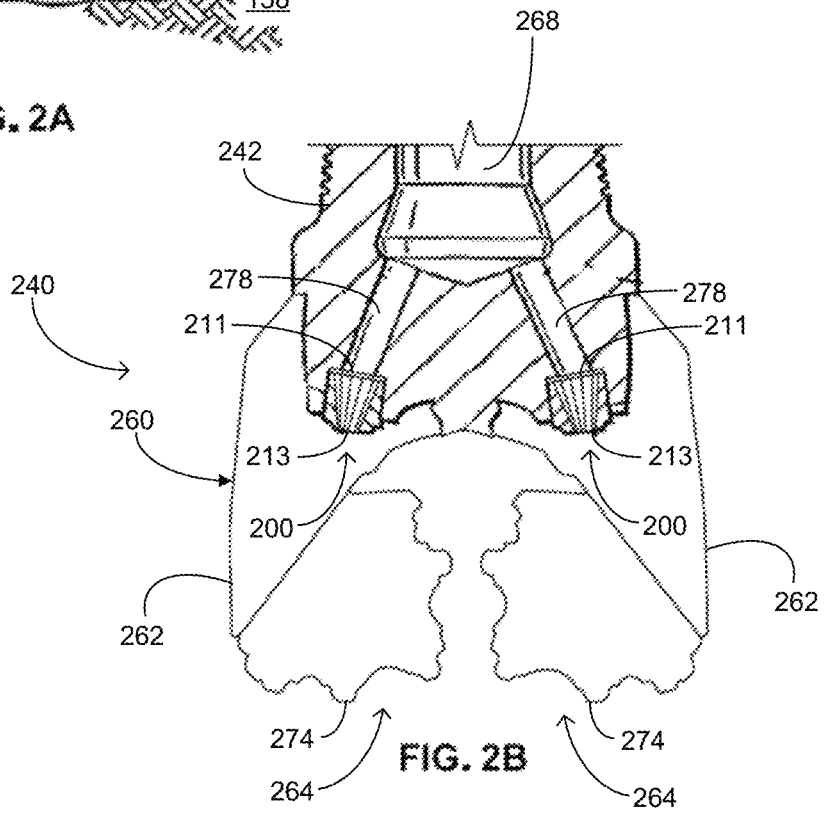
FIG. 2B is a cutaway drawing of the roller-cone type drill bit depicted in FIG. 2A.
Figure 3A:
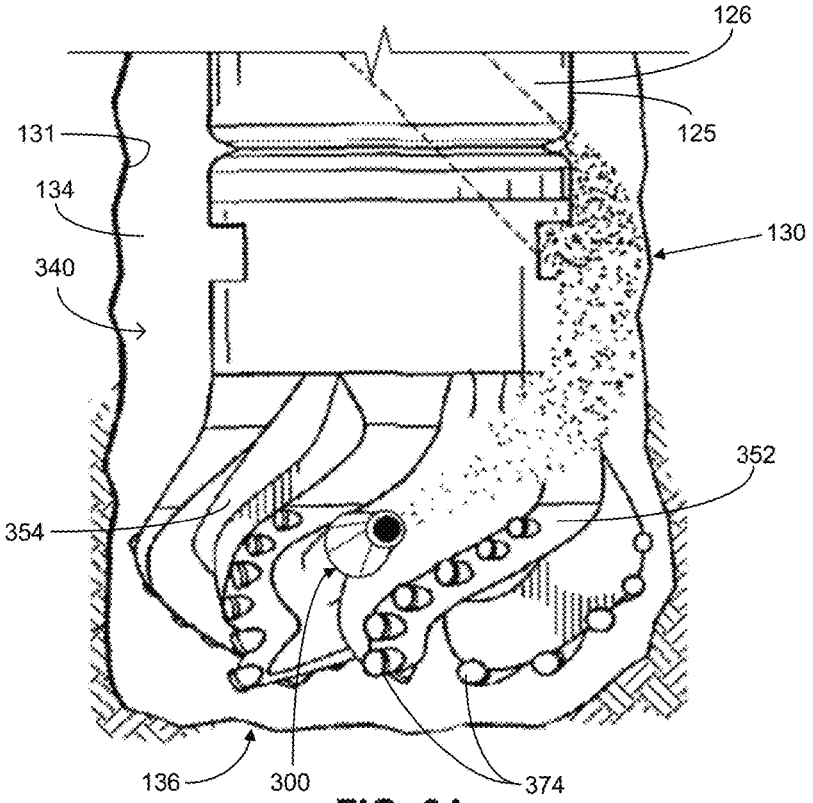
FIG. 3A is a perspective drawing of a fixed cutter type drill bit configured in accordance with some embodiments and that may be incorporated in the drill string depicted in FIG. 1.
Figure 3B:
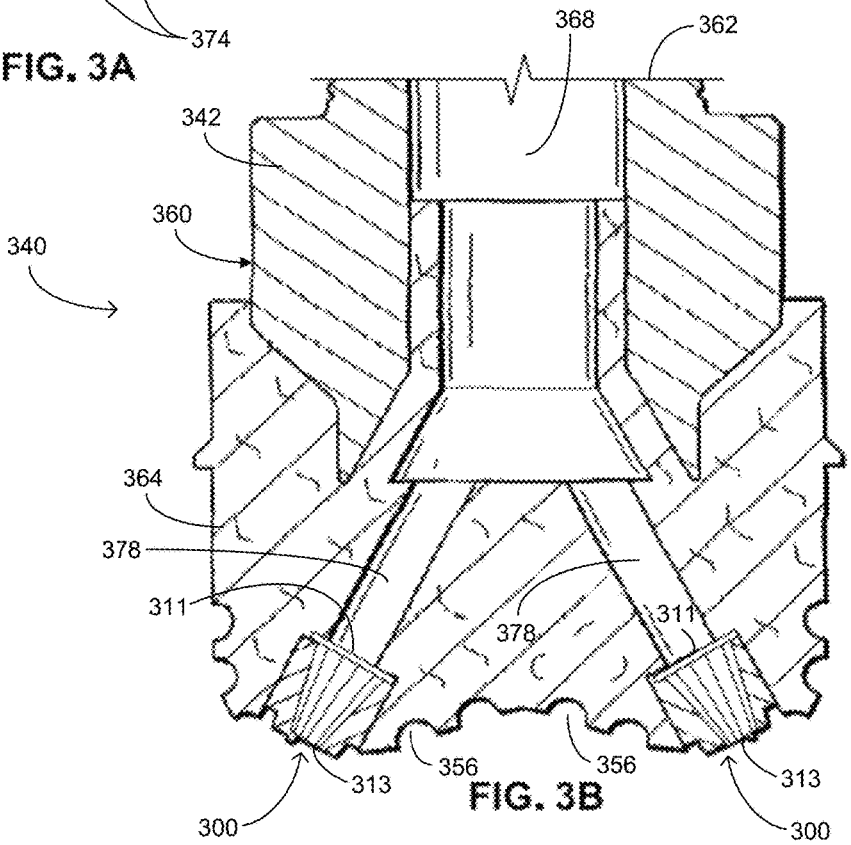
FIG. 3B is a cutaway drawing of the fixed cutter type drill bit depicted in FIG. 2A.

A representative roller-cone configuration for drill bit 140 is depicted in FIGS. 2A and 2B as drill bit 240. Drill bit 240 includes a bit body 260 having a tapered, externally threaded, upper portion 242 for coupling drill bit 240 to with the end of drill string 124. Bit body 260 may be formed from three segments that include substantially identical support arms 262 extending therefrom. The segments may be welded with each other using conventional techniques to form bit body 260. A cavity 268 is formed adjacent to upper portion 242 to receive drilling fluid from drill string 124.

The lower portion of each support arm 262 may include a respective shaft, bearing pin or spindle (not expressly shown). Cone assemblies 264 may be rotatably mounted on respective spindles extending from associated support arm 262. Cone assemblies 264 may also be described as roller cone assemblies, cutter cone assemblies or rotary cone assemblies. Each cone assembly 264 includes a plurality of cutting elements 274 arranged in respective rows. Cutting elements 274 may be formed from a wide variety of materials such as tungsten carbide including monotungsten carbide (WC), ditungsten carbide ($W_{2C}$), macrocrystalline tungsten carbide and cemented or sintered tungsten carbide. In addition to use of diamond surfaces, examples of hard materials that may be used to form cutting elements 274 include various metal alloys and cermets such as metal borides, metal carbides, metal oxides and metal nitrides.

In addition to rotating and applying weight to a drill bit such as drill bit 240, drill string 124 provides a flow conduit for transporting drilling fluids and other fluids from well surface 122 to the drill bit. The drilling fluid flows through conduits of the drill string, into cavity 268, and is discharged from drill bit 240 through one or more nozzles 200 that are disposed at various locations proximate an outer surface of the drill bit body 260 of drill bit 240. In the depicted embodiment, nozzles 200 are disposed on the drill bit face comprising cutting components including cone assemblies 264 and cutting elements 274 supported by drill bit body 260. A plurality of drilling fluid conduits 278 may be formed in drill bit body 260. Each drilling fluid conduit 278 extends from cavity 268 to a respective one of nozzles 200 disposed in drill bit body 260. During a drilling operation, formation cuttings and any other downhole debris generated by drill bit 240 at end face 136 of wellbore 130 mixes with drilling fluids exiting from nozzles 200. The mixture of drilling fluid, formation cuttings and other downhole debris will generally flow radially outward from beneath drill bit 240 and flow upward through annulus 134 to well surface 122.

During drilling, fluid flow proximate the cutting elements may cool the cutting elements, as well as clear debris from the bottom of the wellbore. Each of nozzles 200 has a conical contour with a fixed diameter inlet port 211 coupled to and proximate a respective one of that drilling fluid conduits 278. The fixed diameter inlet port in various embodiments has a diameter that is of greater than a diameter than an outlet port 213 of the same nozzle. In this manner, drilling fluid may be accelerated as it passes from inlet port 211 to the lower pressure outlet port 213 to provide sufficient velocity as the fluid is discharged proximate the exterior of drill bit 240. The flow rate is a relative constant at a given point in time across each of nozzles 200, and in some embodiments determined by the downhole fluid pressure within cavity 268 and drilling fluid conduits 278. However, the fluid discharge velocities from each of nozzles 200 may be impacted by downhole fluid pressures and pressure differentials may vary, increasing or decreased based on a variety of structural factors and the depth at which drill bit 240 is positioned.

Nozzles 200 include features that address flow velocity control issues that may arise due to changing drilling fluid pressures downhole and/or drilling operation requirements such as variations in formation strata. In one aspect, each of nozzles 200 includes an outlet port 213 comprising an adjustable size orifice. The adjustable diameter setting for the outlet port 213 of each nozzle 200 may be determined based on a target fluid velocity of a respective discharge stream in combination with other factors, such as internal drilling fluid pressure that the discharge velocity is also a function of. In some embodiments, the target fluid velocity may be determined based on a desired drilling efficiency of drill bit 240 and/or rate of penetration (ROP) of drill bit 240.

For embodiments such as shown in FIG. 2A, a fluid stream 290 is shown exiting from nozzle 200 and flowing around adjacent cutter cone assembly 264 and bit body 260. Drilling fluid exiting from nozzle 200 may be relatively free from particulate matter such as formation cuttings. As fluid stream 290 contacts portions of wellbore 130, the concentration of particulate matter (formation cuttings and downhole debris) may substantially increase. The resulting flow stream of drilling fluid and particulate matter swirls around BHA 126 and drill string 124 above drill bit 240.

Establishment of a swirling, spiral flow stream within well annulus 134 represents one aspect of determining effectiveness of nozzles 200. A balance is often required between the energy required to organize desired fluid flow within well annulus 134 and efficiency of nozzles 200 in converting drilling fluid pressure into usable velocity and associated kinetic energy to remove formation materials from end face 136 of wellbore 130, and to clean associated cutting structures of drill bit 240. As depicted and described in further detail with reference to FIGS. 4-8C, one or more of nozzles 200 may comprise jet nozzle assemblies configured to implement target flow velocities required to optimize the overall downhole flow stream.

With reference to FIGS. 3A and 3B in combination with FIG. 1, a representative fixed cutter configuration for drill bit 140 is depicted and represented as drill bit 340. Drill bit 340 includes a bit body 360 having a tapered, externally threaded portion 342 for coupling drill bit 340 to the end of drill string 124. For some applications bit body 360 may include a metal shank 362 and a matrix material 364 securely attached thereto. Metal shank 362 has a generally hollow, cylindrical configuration defined in part by a cavity 368. Examples of matrix materials may include, but are not limited to, a wide variety of hard, brittle non-metallic refractory materials such as carbide, carbon nitride, cemented carbides, macrocrystalline tungsten carbide powders. The matrix materials may include one or more binders selected from the group consisting of, but not limited to, copper, cobalt, nickel, iron and/or alloys of these materials.

Fixed cutter drill bits such as drill bit 340 may include a plurality of cutting elements, inserts, cutter pockets, blades, cutting structures, junk slots, and/or fluid flow paths formed on or attached to exterior portions of an associated bit body. As depicted in FIGS. 3A and 3B, a plurality of blades 352 are disposed on the exterior of bit body 360. Blades 352 may be spaced from each other on the exterior of bit body 360 to form fluid flow paths or junk slots 354 therebetween.

Cutting action or drilling action for drill bit 340 occurs as cutting elements 374 attached to blades 352 scrape and gouge end face 136 and adjacent portions of inside surface 131 of wellbore 130 during rotation of drill string 124. A plurality of pockets or recesses 356 may be formed in blades 352 at selected locations. Respective cutting elements or inserts 374 may be securely mounted in each of pockets or recesses 356 to engage and remove adjacent portions of a downhole formation. Cutting elements or inserts 374 may scrape and gouge formation materials from the bottom and sides of a wellbore during rotation of drill bit 340 by attached drill string 124. The resulting inside surface 131 of wellbore 130 may correspond approximately with the outside diameter or gauge diameter of bit body 360. The combined action of blades 352 and cutting elements 374 form inside surface 131 of wellbore 130 in response to rotation of drill bit 340.

In addition to rotating and applying weight to drill bit 340, drill string 124 provides a conduit for transporting drilling fluids and other fluids from well surface 122 to drill bit 340. Such drilling fluids flow from drill string 124, through conduits in drill bit 340, and are discharged from drill bit 340 through a plurality of nozzles 300. Bit body 360 includes a cavity 368 that receives drilling fluid from drill string 124. A plurality of drilling fluid conduits 378 may be formed in bit body 360. Each drilling fluid conduit 378 is in fluid communication with cavity 368, and extends from cavity 368 to a respective one of nozzles 300 disposed in bit body 360. Formation cuttings generated by drill bit 340 and any other downhole debris at end face 136 of wellbore 130 mixes with drilling fluids exiting from nozzles 300. The mixture of drilling fluid, formation cuttings and other downhole debris will generally flow radially outward from beneath drill bit 340 and/or through junk slots 354, and may then continue to flow upward through annulus 134 to well surface 122.

During drilling, fluid flow proximate the cutting elements may cool the cutting elements, as well as clear debris from the bottom of the wellbore. Similar to nozzles 200, each of nozzles 300 has a conical contour with a fixed diameter inlet port 311. The fixed diameter inlet port in various embodiments has a diameter that is greater diameter than a corresponding outlet port 313 of the same respective nozzle. In this manner, drilling fluid is accelerated as it passes from an inlet port 311 to a respective outlet port 313 to provide sufficient fluid velocity as the fluid is discharged proximate the exterior of drill bit 340. The flow rate is a relative constant at a given point in time across each of nozzles 300 and may be determined by the downhole fluid pressure within cavity 368 and drilling fluid conduits 378. However, the fluid discharge velocities from each of nozzles 300 may be impacted by downhole fluid pressures and pressure differentials may vary, increasing or decreased based on a variety of structural factors and the depth at which drill bit 340 is positioned.

Nozzles 300 include features that address flow velocity control issues that may arise due to changing drilling fluid pressures downhole and/or drilling operation requirements such as variations in formation strata. In one aspect, each of nozzles 300 includes an outlet port 313 comprising an adjustable size orifice. The adjustable diameter setting for the outlet port 313 of each nozzle 300 may be determined based on a target fluid velocity of a respective discharge stream in combination with other factors, such as internal drilling fluid pressure that the discharge velocity is also a function of. In some embodiments, the target fluid velocity may be determined based on a desired drilling efficiency of drill bit 340 and/or ROP of drill bit 340. The target fluid velocity may also or alternatively be determined based on performance parameters for drilling operation in which a substantial function of the discharged fluid stream is to hydrodynamically cut, abrade, and/or erode downhole strata as a significant part of borehole formation. In such embodiments, the target fluid velocity may be determined based on a target hydraulic horsepower and/or jet impact force, for example.

As described above, FIGS. 1, 2A, 2B, 3A, and 3B depict embodiments of a drilling system and rotary drill bits that includes jet nozzles configured to accelerate drilling fluid received at an inlet port, Embodiments of the drilling systems and the rotary drill bits as illustrated and described with respect to these figures may be further configured to includes a variable diameter outlet port to, for example, dynamically adjust fluid acceleration during drilling operations.

Figure 4:
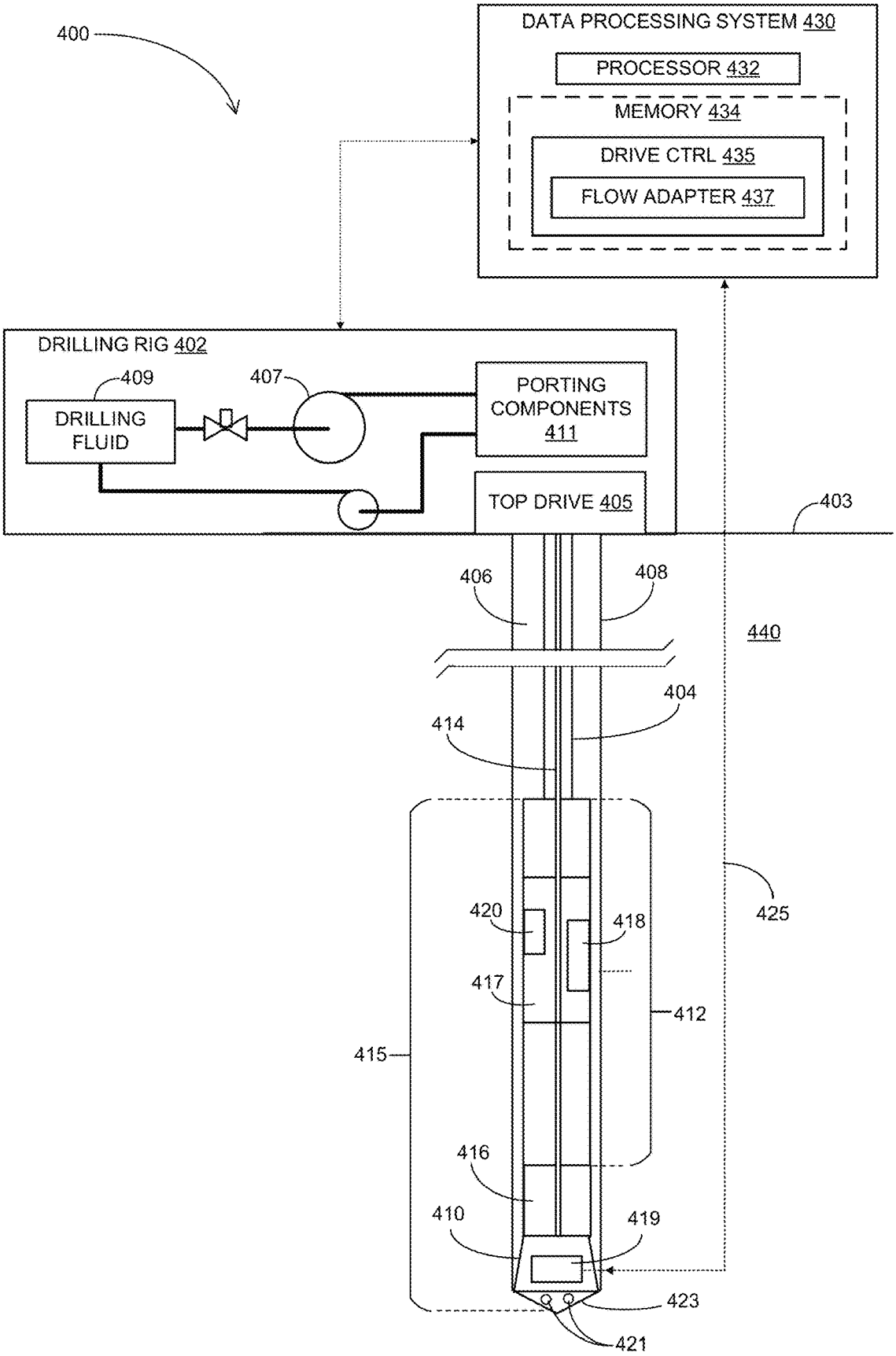
FIG. 4 is a schematic diagram depicting a drilling system that includes adjustable drill bit nozzles and a corresponding control system in accordance with some embodiments.

FIG. 4 is a schematic diagram depicting a drilling system 400 that includes adjustable drill bit nozzles and a corresponding control system in accordance with some embodiments. Drilling system 400 includes a drilling rig 402 comprising various mechanical and electronic systems, subsystems, devices, and components configured to lower, rotate, and otherwise operate a drill string. The drill string includes, among other components, a section of drilling pipe 404 coupled at one end to a top drive 405 within drilling rig 402, which is disposed on an above ground surface 403. Drilling pipe 404 is coupled at the other end to a BHA 415 that includes a drill bit 410 on its lower end. BHA 415 further includes a steering actuator 416 configured either as a rotary steering system or motor driven device to determine the drilling direction by adjusting the direction of drill bit 410.

Drill bit 410 may be actuated by rotation imparted to the drill string by the top drive 405 within drilling rig 402. A borehole 406 having a cylindrically contoured borehole wall 408 is formed as drill bit 410 is rotated within a subterranean region 440. As drill bit 410 rotates, a pump 407 within drilling rig 402 pumps drilling fluid, sometimes referred to as "drilling mud," from a drilling fluid source 409 downward through a drilling fluid conduit 414 that is formed within the various sections of the drill string. Pump 407 drives the drilling fluid through various porting components 411 such as intermediate pipes and into drilling fluid conduit 414 that provides a flow path into drill bit 410. Drill bit 410 includes one or more adjustable nozzles 421 that provide variable acceleration of drilling fluid within the nozzles depending on variable diameter discharge orifices such as depicted and described with reference to FIGS. 1, 2A, 2B, 3A, and 3B and as further illustrated and described with respect to FIGS. 5-8C.

BHA 415 further includes a drill collar 412 that provides downward weight force on drill bit 410 for drilling. Drill collar 412 comprises one or more thick-walled cylinders machined from various relatively high-density metals or metallic alloys. While not expressly depicted in FIG. 4, drill collar 412 may comprise multiple distinct cylindrical members that are interconnected using releasable connections such as threaded connectors integral to the individual drill collar members.

Drill collar 412 is further configured to support a tool assembly 417 that includes a set of one or more sensors 420 configured to measure or otherwise determine downhole metrics relating to physical conditions and/or material properties. For example, sensors 420 may be configured to measure temperature, pressure, and/or material properties to determine, for example, the material composition of various layers within subterranean region 440. Tool assembly 417 further includes information processing and communication module 418 for transmitting the measured information via a telemetry link 425 to a data processing system 430. Telemetry link 425 includes transmission media and endpoint interface components configured to employ a variety of communication modes. The communication modes may comprise different signal and modulation types carried using one or more different transmission media such as acoustic, electromagnetic, and optical fiber media. Data processing system 430 may also receive drilling operations information from drilling rig 402. Such operations information may include ROP and other drilling metrics as well as drill bit metrics such as drill bit temperature. The operations information may further include detection of events significant to drilling performance such as detection of stick-slip events.

During drilling operations, information from tool assembly 417 and drilling operation information from drilling rig 402 are processed by data processing system 430 to determine or adjust various drilling operation parameters such as drill bit ROP, rotation speed, drilling fluid flow rate, as well as other parameters. Downhole environmental conditions such as temperature and fluid pressure may also be monitored and detected. Data processing system 430 includes a processor 432 and a memory device 434 into which a control application 435 is loaded. Control application 435 comprises program instructions configured to track current drilling operations by retrieving information from drilling rig 402 and/or tool assembly 417 and dynamically adjusting drilling operation parameters based on the information. In one aspect, control application 435 incudes a flow adapter 437 comprising program instructions configured to process the drilling operations information and downhole environment information to detect or otherwise determine whether and in what manner drilling fluid flow should be adjusted. Drill bit 410 includes a drill bit face 423 that includes among other components and features such as cutting elements, a set of nozzles 421 having flow velocities that may be adjusted in accordance with the embodiments disclosed herein. In some embodiments, flow adapter 437 is configured to process drilling operations information and downhole environment information to determine whether and in what manner adjustable outlet orifices of nozzles 421 should be adjusted.

During drilling operation, information received from drilling rig 402 and tool assembly 417 are collected and processed by flow adapter 437 to determine target flow metrics such as fluid discharge velocity from nozzles 421. Flow adapter 437 generates corresponding flow adjustment instructions that are transmitted to a control module 419 within or proximate to drill bit 410. In some embodiments, control module 419 comprises electro-mechanical components and processing components configured to adjustably control the orifice diameter of nozzles 421 based on the instructions generated by flow adapter 437. For example, control module 419 may comprises an electro-mechanical actuator assembly such as one or more of the assemblies depicted in FIGS. 6 and 7.

In addition to the actuator assembly components, control module 419 may also include some of the sensors such as drill bit temperature sensors described with reference to tool assembly 417. Control module 419 may further include bit motion sensors such as acceleration sensors to measure metrics such as drill bit rotational speed and also detect operational events such as stick-slip events. As with the operational information detected/measured by sensors within tool assembly 417, the rotational speed and acceleration information and events information measured by sensors within control module 419 may be recorded downhole such as by communication module 418 and transmitted continuously or intermittently to data processing system 430.

In some embodiments, control module 419 may be programmed or otherwise configured to modify the flow settings in response to locally determined conditions without communicating with drilling rig 402 or data processing system 430. For example, control module 419 may detect or receive an indication of a high-pressure condition within a fluid conduit included as part of the drill string (e.g., within or proximate to drill bit 410). In response, control module 419 may implement actuation of nozzle orifice control features to, for example, expand a nozzle outlet orifice for one of nozzles 421 to clear an obstruction.

Figure 5A:
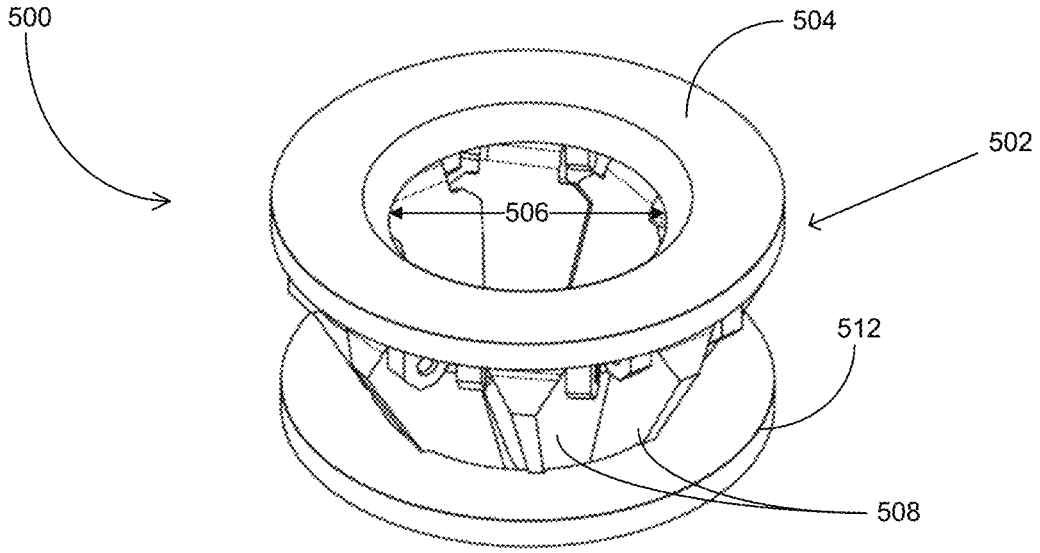
FIG. 5A is a perspective drawing of a drill bit nozzle in accordance with some embodiments.

FIGS. 5A-5E are drawings illustrating a drill bit nozzle 500 such as may be implemented in a drilling system such as wellbore drilling systems 100 and 400 in accordance with some embodiments. As shown in the views of FIGS. 5A- and 5D, drill bit nozzle 500 includes a conical or frustum contoured nozzle body 502 that includes an inlet frame 504 that in the depicted embodiment is an annular disk formed of a substantially rigid material. A circular inlet orifice 506 having a fixed diameter is formed in the center of inlet frame 504. For the configurations shown in FIGS. 2A, 2B, 3A, and 3B, inlet frame 504 may form the fixed diameter orifice inlets of the nozzles 200 and 300. In such embodiments, inlet orifice 506 as shown in FIGS. 5A-5E is the inlet port through which drilling fluid flows from internal drill bit fluid conduits and cavities such as those depicted in FIGS. 2A, 2B, 3A, and 3B.

Referring back to FIGS. 5A-5F, the sloped conical contour of nozzle body 502 is formed by a plurality of movable closure elements that are circumferentially arranged to form an inlet orifice, an outlet orifice, and a fluid a passage to transport fluid from the inlet orifice to the variable diameter outlet orifice. The movable closure elements may be in the form of slats 508 that are circumferentially arranged along the circular perimeter of inlet frame 504. Each of slats 508 comprises a substantially rigid material formed into elongated members having a proximal end 520 that is rotatably attached to inlet frame 504 at a respective position around inlet orifice 506. As shown particularly in FIG. 5D, a set of correspondingly positioned rotation hinges 514 provide the depicted rotational attachment of the proximal ends of each of slats 508 to inlet frame 504.

Between the proximal end 520 and an opposing distal end 522, each of slats 508 includes a pair of lengthwise edges 516. As shown in FIGS. 5B, 5C, 5D, and 5E, the lengthwise edges of slats 508 are beveled and generally contoured to have wedge angles such that the lengthwise edges slidably overlap with the lengthwise edges of adjacent slats 508. FIG. 5E illustrates a partial cross-section and partial cutaway view of the side view in FIG. 5D and showing the overlap of lengthwise edges 516 between adjacent slats 508. As shown by the combination of perspectives, the overall combined effect is that the overlapping edges of slats 508 form a conical or frustum contoured inner fluid passage through which fluid flows and accelerates as it propagates from inlet frame 504 along the length of the inner fluid passage.

Figure 5B:
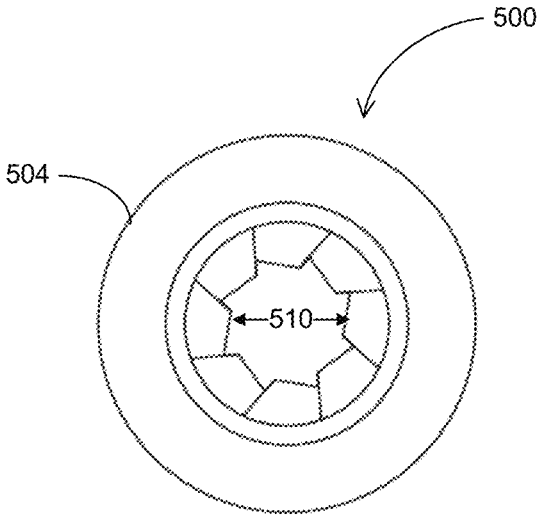
FIG. 5B is a top view of the drill bit nozzle of FIG. 5A depicting the variable outlet orifice having a first diameter at a first point in time, according to some embodiments.

The distal ends 522 of slats 508 form a variable diameter outlet orifice 510 as illustrated in FIG. 5B, which is a top view of the drill bit nozzle of FIG. 5A depicting the variable outlet orifice having a first diameter at a first point in time, and 5C, which is a top view of the drill bit nozzle of FIG. 5A depicting the variable outlet orifice having a second diameter at a second point in time. Outlet orifice 510 comprises a circumferentially contoured orifice formed by the overlapping edges of slats 508 that form an iris-like shutter that varies the contouring in terms of steepness of the conically contoured inner fluid passage as well as forming the variable diameter orifice itself. In the depicted embodiment, drill bit nozzle 500 further includes a ring member 512 that is circumferentially disposed in unattached outer radial surface contact around the circumferentially-configured plurality of slats 508. Ring member 512 is depicted as being annularly contoured and substantially rigid integrated member that is incorporated in an electromechanical actuator mechanism to vary the flow rate through drill bit nozzle 500. The inner surface of ring member 512 maintains contact with the outer surfaces 518 of slats 508 to deflect slats 508 inwardly proportionately to the linear position of ring member 512 between proximal end 513 and distal end 515. The deflection of slats 508 by the inner surface of ring member 512 provides variable control of the diameter of outlet orifice 510 while maintaining a fixed inlet orifice diameter 506 for any given position of ring member 512 moving linearly in parallel with the flow path of drill bit nozzle 500. In this manner, the diameter of outlet orifice 510 varies as ring member 512 moves along different points between the nozzle inlet and nozzle outlet. When utilized in any of the configurations shown in FIGS. 1, 2A, 2B, 3A, 3B, and -4, the fluid pressure applied by drilling fluid within the inner flow passage of drill bit nozzle 500 maintains substantially constant pressure driven contact of slats 508 with the inner surface of ring member 512.

Figure 5C:
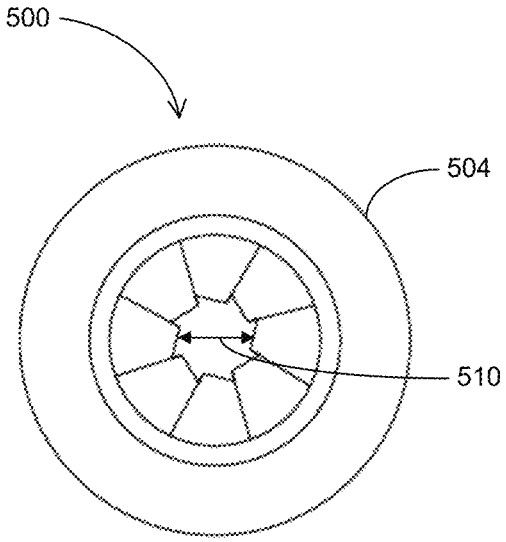
FIG. 5C is a top view of the drill bit nozzle of FIG. 5A depicting the variable outlet orifice having a second diameter at a second point in time, according to some embodiments.
Figure 5D:
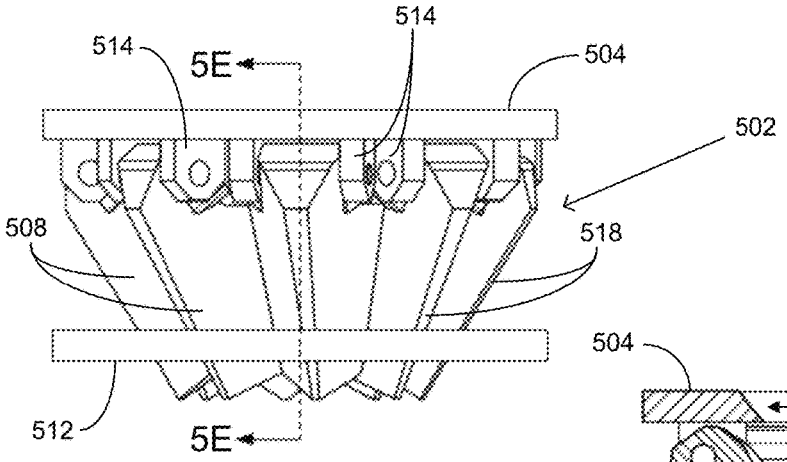
FIG. 5D is a side perspective view of the drill bit nozzle of FIG. 5A, according to some embodiments.
Figure 5E:
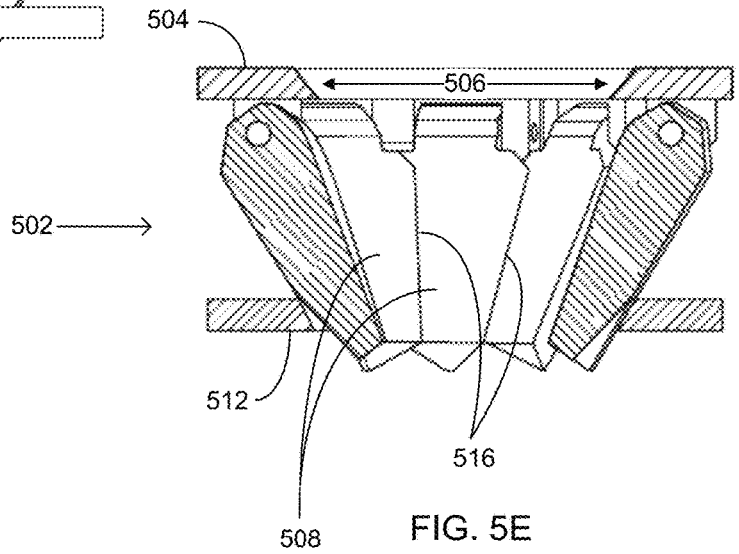
FIG. 5E is a side cutaway view of the drill bit nozzle of FIG. 5A, according to some embodiments.
Figure 5F:
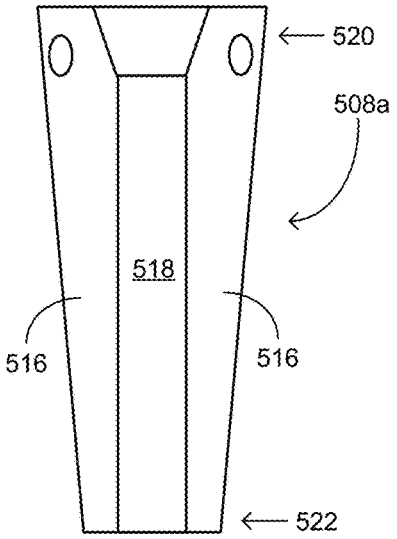
FIG. 5F is an overhead perspective view of an individual slat member that may be included in the drill bit nozzle shown in FIGS. 5A-5E, according to some embodiments.
Figure 5G:
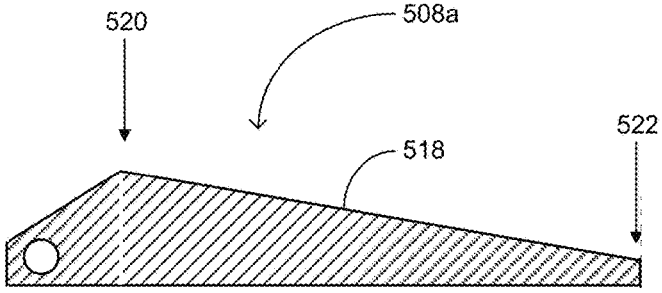
FIG. 5G is a side cross-section view of an individual slat member that may be included in the drill bit nozzle shown in FIGS. 5A-5E, according to some embodiments.

FIG. 5F is an overhead perspective view and FIG. 5G is a side cross-section view of an individual slat 508*a* implemented as a representative one of slats 508 in drill bit nozzle 500. Slat 508*a* is contoured to both facilitate the lengthwise edge overlap as well as to enable or enhance the variation in the outlet orifice diameter corresponding to linear displacement of ring member 512. Slat 508*a* comprises lengthwise edges 516 that extend between proximal end 520 and distal end 522. Proximal end 520 is the end at which slat 508*a* is rotationally attached using some form of rotating hinge when slat 508*a* is deployed as part of a drill bit nozzle. Distal end 522 is the end that, along with the circumferentially configured other distal ends of slats 508, forms variable outlet orifice 510 as depicted in FIGS. 5B and 5C. Lengthwise edges 516 may be ramped at a wedge angle to facilitate slidable overlap between the lengthwise edges of adjacent slats 508. To further facilitate non-obstructed overlap between lengthwise edges 516 to form a conical and/or frustum-contoured body, slat 508*a* is a trapezoidal contoured member as illustrated in the front perspective view of FIG. 5F. The steepness of the trapezoidal contoured in determined by the angular configuration of lengthwise edges 516 in which, as illustrated in FIG. 5F, the overall width of slat 508*a* decreases from proximal end 520 to distal end 522.

Between lengthwise edges 516 and also extending along the length between proximal end 520 and distal end 522 is what may be referred to herein as a radially outward facing surface is outer surface 518. Referring to FIG. 5D in combination with FIG. 5F, outer surface 518 may be referred to as radially outward facing in reference to its position as being on the outer circumference of the cone/frustum formed by slats. In this position, outer surface 518 contacts the inner surface of ring member 512. In the depicted embodiment, outer surface 518 is a ramped surface that ramps at a positive (upward) angle from second end 522 to first end 520. With outer surface 518 ramped in this manner the contact between fixed inner diameter surface of ring member 512 and outer surface 518 causes greater rotational deflection of slat 508*a* as control ring moves from distal end 522 to proximal end 520.

Figure 6:
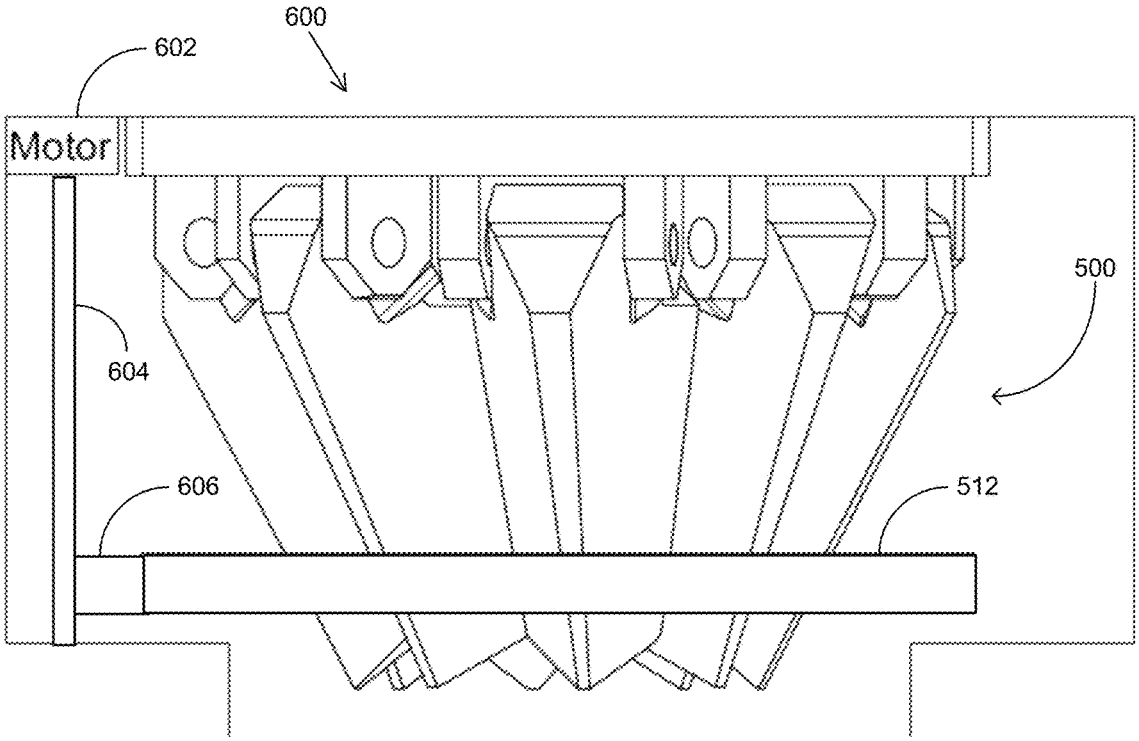
FIG. 6 is a drawing depicting an adjustable jet nozzle assembly in accordance with some embodiments.

Drill bit nozzles and nozzle assemblies deployed on drill bits may further include actuation means configured to linearly displace a control ring such as ring member 512. FIG. 6 is a schematic drawing depicting an adjustable jet nozzle assembly 600 that includes drill bit nozzle 500 and an electromechanical actuator to controllably move the control ring of a nozzle in accordance with some embodiments. The electromechanical actuator includes a motor 602, that may be a stepper motor for example. In some embodiments, motor 602 may comprise another type of motive force provider such as a hydro-mechanical motor. Motor 602 may be disposed proximate to drill bit nozzle 500 such as within a fluid nozzle module formed within a drill bit. Internal rotation of motor 602 is translated to linear motion such as by driving a linear displacement track member 604 that is attached to an actuator arm 606 that is coupled to ring member 512. Linear displacement of track member 604 may be actuated and controlled, for example, based on instructions transmitted from a control system such as data processing system 430 (FIG. 4) to a controller (not depicted) for motor 602.

Figure 7:
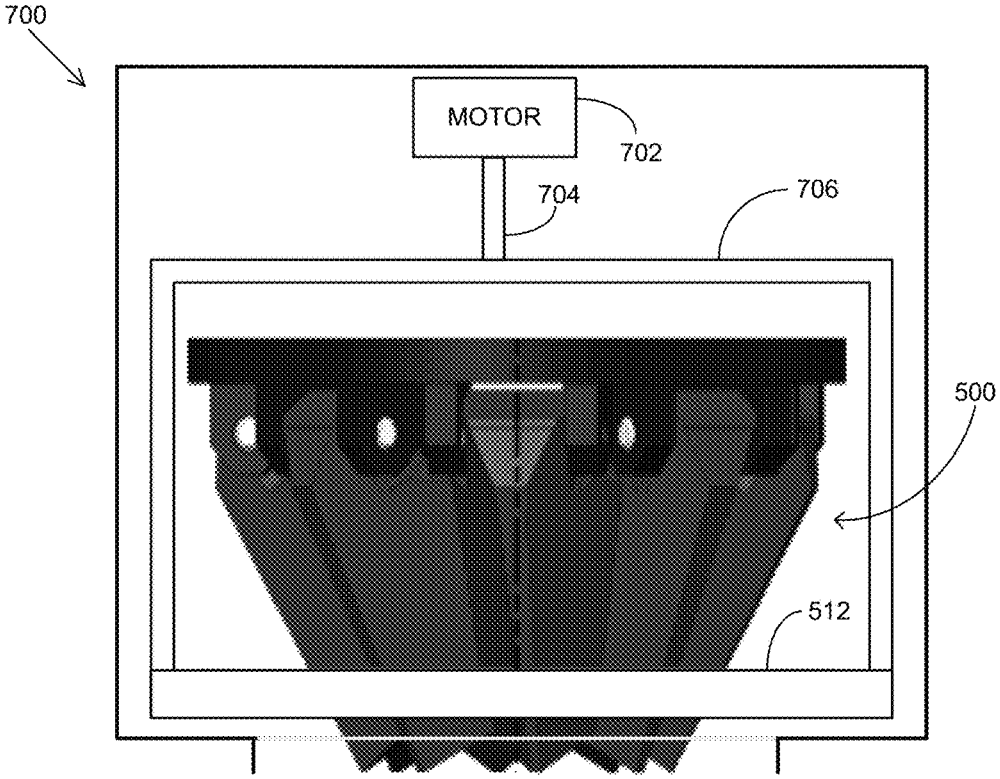
FIG. 7 is a drawing depicting an adjustable jet nozzle assembly in accordance with some embodiments.

FIG. 7 is a schematic drawing illustrating an adjustable jet nozzle assembly 700 that includes drill bit nozzle 500 and an electromechanical actuator to controllably move the control ring of a nozzle in accordance with some embodiments. The electromechanical actuator includes a motor 702, that may be a stepper motor for example or another type of motor such as a hydro-mechanical motor. Motor 702 may be disposed proximate to drill bit nozzle 500 such as within a fluid nozzle module formed within a drill bit. In other embodiments, the actuator assembly may be configured such that motor 702 (and similarly motor 602, FIG. 6) may be disposed at other locations within the drill bit or drill string. Internal rotation of motor 702 is translated to linear motion such as by driving a linear displacement track member 704 that is attached to an actuator frame 706 that is coupled to ring member 512 at multiple points to provide more rigid support that may be require for high-pressure downhole environments. Linear displacement of track member 704 may be determined, for example, on instructions transmitted from a control system such as data processing system 430 (FIG. 4) to a controller (not depicted) for motor 702.

Figure 8A:
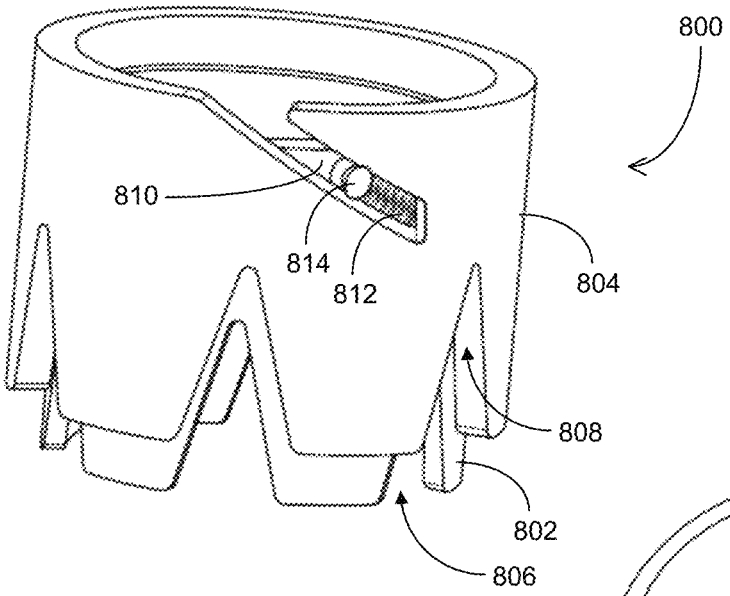
FIG. 8A is a perspective view illustrating a drill bit nozzle configured to utilize rotational actuation, according to some embodiments.
Figure 8B:
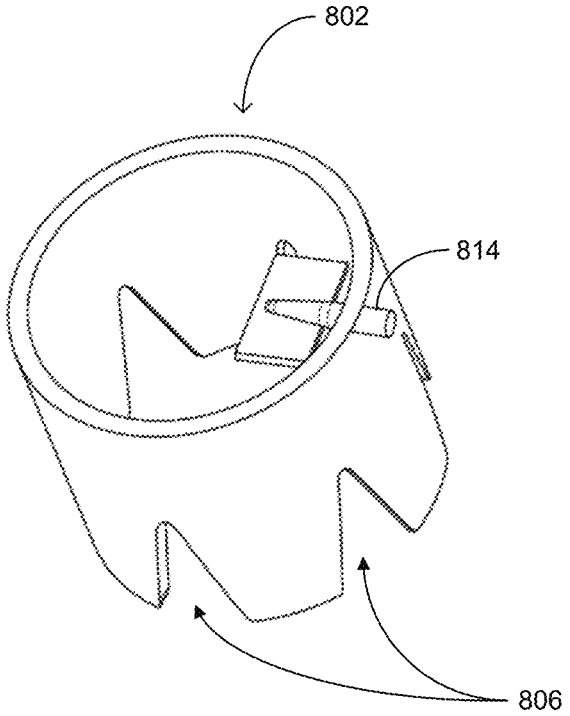
FIG. 8B is a perspective view illustrating an inner frustum-contoured member included within the drill bit nozzle shown in FIG. 8A.
Figure 8C:
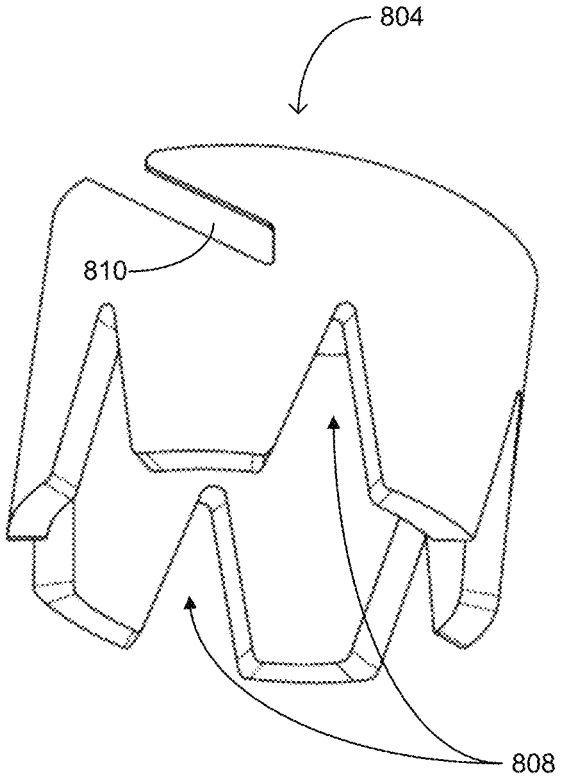
FIG. 8C is a perspective view depicting an outer frustum-contoured member included within the drill bit nozzle shown in FIG. 8A.

FIGS. 8A-8C are perspective drawings illustrating a drill bit nozzle 800 configured in accordance with some embodiments. Drill bit nozzle 800 is configured to provide controlled, adjustable fluid acceleration of a fluid, such as a drilling fluid or drilling mud, flowing through drill bit nozzle 800. Drill bit nozzle 800 includes an inner frustum-contoured member 802 disposed within a similarly contoured but larger diameter outer frustum-contoured member 804. Each of members 802 and 804 include an inlet end comprising a substantially uniform flat surface and an outlet end having outlet slots formed therein. The outlet end of frustum-contoured member 802 includes multiple fluid discharge slots 806 that are V-shaped in the depicted embodiment. The outlet end of frustum-contoured member 804 includes multiple fluid discharge slots 808 that are also V-shaped and have the same surface area as slots 806. In this manner, a maximum outflow surface is provided with when slots 806 are aligned with slots 808 and a minimum surface is provided when there is no overlap between slots 806 and 808.

The depicted embodiment includes a rotational actuator to control the amount of alignment between slots 806 and 808. The depicted rotational actuator includes an actuator arm 814 extending outwardly from inner frustum-contoured member 802 into an actuator slot 810 formed within outer frustum-contoured member 804. The rotational actuator further includes a spring 812 disposed within actuator slot 810 and configured to apply a force to actuator arm 814 when spring 812 is compressed or extended such as may be implemented by an electromechanical actuator (not depicted). The force applied to actuator arm 814 results in rotation of inner frustum-contoured member 802 relative to outer frustum-contoured member 804 resulting in either more or less alignment between slots 806 and 808 and corresponding changes in flow and fluid velocity.

Figure 9:
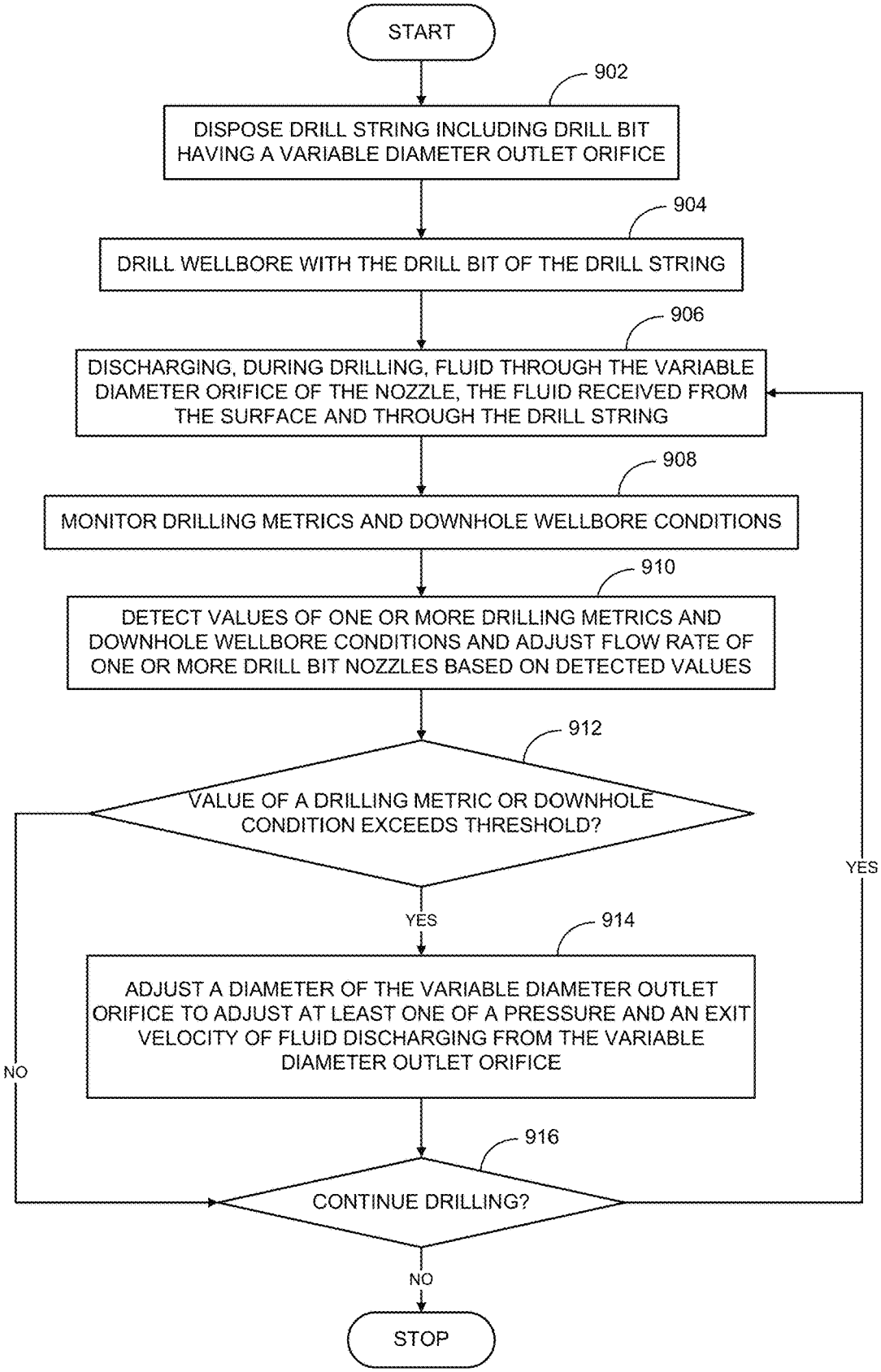
FIG. 9 is a flow diagram depicting operations and functions performed during drilling operations in which adjustable drill bit nozzles are deployed, according to some embodiments.

FIG. 9 is a flow diagram depicting one or more methods that may include operations and/or functions performed during drilling operations in which adjustable drill bit nozzles are deployed, according to various embodiments. The operations and functions shown in FIG. 9 may be implemented by one or more of the systems, sub-systems, devices, and components depicted and described with reference to FIGS. 1-8C. The process begins as shown at block 902, with a drill string that includes a drill bit having one or more drill bit nozzles being disposed into a wellbore. As shown in FIGS. 1 and 4, the drill string may include several components that couple the drill bit to surface equipment and a drill bit including one or more drill bit nozzles. As depicted and described with reference to FIGS. 2A, 2B, 3A, 3B, 5A-5F, 6, 7, and 8A-8C, the drill bit nozzles may comprise a variable diameter outlet orifice that may be adjusted based on control information received from a control processing system such as data processing system 430 in FIG. 4.

At block 904, the drill string engages motive and directional drilling equipment such as a surface top drive and/or downhole rotary steering system to actuate the drill bit during drilling of a portion of a wellbore. As shown at block 906, the drilling operation includes discharge of drilling fluid from the surface and through the drill string components until being discharged from the variable diameter orifice on the one or more drill bit nozzles. During drilling, downhole conditions may be continuously and/or intermittently monitored such as by one or more downhole sensors and drilling operation feedback interfaces (block 908).

As a result of at least some of the monitoring at block 908, drilling operation and environment metrics may be detected that are utilized by a flow control system such as flow adapter 437 (FIG. 4) to adjust the flow rate of one or more of the drill bit nozzles as shown at block 910. The drilling operation metrics may include drilling fluid flow rate or blockage, drilling ROP, drill bit temperature, as well as other operational parameters that may influence or be influenced by the flow rate from the drill bit nozzles. The environmental metrics may include downhole temperature and fluid pressure.

At inquiry block 912, a determination is made of whether one or more values of a drilling metric and/or a downhole environment metric exceeds a threshold. For example, detecting fluid pressure within the drill string that exceeds a threshold may correspond to a drill bit nozzle that is plugged such as by downhole debris. If a drilling metric and/or downhole environment metric has been exceeded ("YES" arrow extending from block 912), control passes to block 914, wherein a diameter of the variable diameter outlet orifice(s) of one or more drill bit nozzles are adjusted. In some embodiments, the diameter of the outlet orifice(s) are adjusted to implement an adjusted value for fluid pressure and exit velocity of drilling fluid discharged from the drill bit nozzles. During periods in which thresholds for drilling operation and downhole metrics to not exceed a threshold ("NO" arrow extending from block 912), the drilling operation may continue without adjusting the drilling fluid flow rate through the drill bit nozzles as shown at block 916 with control passing back to block 906 ("YES" arrow extending from block 916) until drilling operation is halted ("NO" arrow extending from block 916).

EXAMPLE EMBODIMENTS

Embodiment 1: A drill bit nozzle comprising: a body having a plurality of movable closure elements circumferentially arranged to form an inlet orifice, a variable diameter outlet orifice, and a fluid a passage to transport fluid from the inlet orifice to the variable diameter outlet orifice; and an actuator configured to vary a diameter of the variable diameter outlet orifice based on a change of position of the plurality of movable closure elements. For Embodiment 1, said plurality of movable closure elements may comprise a plurality of slats each having a first end, a second end, and a pair of lengthwise edges extending between the first end and the second end, each slat contoured to overlap with lengthwise edges of one or more adjacent slats, wherein each first end is rotationally attached at a respective position around the inlet orifice, and wherein the second ends form the variable diameter outlet orifice. For Embodiment 1, said actuator may further include a ring member disposed circumferentially around the plurality of slats, and each slat may comprise a radially outward facing surface that is ramped between the second end and the first end such that said ring member imparts greater or lesser deflection on said plurality of slats as said ring member is linearly displaced along said radially outward facing surface. For Embodiment 1, the radially outward facing surface may ramp upwardly from the second end to the first end such that said ring member imparts greater deflection on said plurality of slats as said ring member is linearly displaced away from the second end to the first end. For Embodiment 1, the pair of lengthwise edges may comprise beveled edges. For Embodiment 1, each of the slat members may comprise a trapezoidal contoured member in which the first end is wider than the second end. For Embodiment 1, said actuator may comprise an electromechanical actuator configured to linearly displace said ring member along positions between the inlet orifice and the variable diameter outlet orifice. For Embodiment 1, said actuator may comprise a motor and actuator arm, wherein the actuator arm is coupled to said ring member and wherein the motor is configured to linearly displace the actuator arm.

Embodiment 2: A drill bit assembly comprising: a body member having at least one fluid port; a bit face supported by said body member and including one or more cutter elements; and one or more nozzle assemblies disposed within said bit face and configured to discharge fluid received from the at least one fluid port, wherein each of said one or more nozzle assemblies includes a fixed diameter nozzle inlet and a variable diameter nozzle outlet. For Embodiment 2, each of said one or more nozzle assemblies may comprise a plurality of closure elements each rotatably attached at a proximal end around a perimeter of the fixed diameter nozzle inlet, wherein distal ends of the plurality of closure elements form the variable diameter nozzle outlet. For Embodiment 2, each of the one or more nozzle assemblies further comprises a ring member disposed circumferentially around the plurality of closure elements. For Embodiment 2, the drill bit assembly may further comprise an actuator configured to linearly displace said ring member along positions between the fixed diameter inlet and the variable diameter outlet. For Embodiment 2, each closure member may comprise a slat having a radially outward facing surface that ramps upwardly from the distal end to the proximal end such that said ring member imparts greater deflection on the slats as said ring member is linearly displaced away from the distal end to the proximal end. For Embodiment 2, each of said one or more nozzle assemblies may comprise an inner frustum-contoured body member disposed within an outer frustum-contoured body member, wherein the inner frustum-contoured body member and the outer frustum-contoured body member have a plurality of discharge slots formed therein. For Embodiment 2, each of said one or more nozzle assemblies may include a rotational actuator comprising: an actuator arm extending outwardly from the inner frustum-contoured body member into an actuator slot formed within the outer frustum-contoured body; and a spring disposed within the actuator slot and configured to apply a force to the actuator arm when the spring is compressed or extended. For Embodiment 2, the discharge slots of the inner frustum-contoured body may be aligned with the discharge slots of the outer frustum-contoured body when the actuator arm is positioned within the actuator slot such that the spring is compressed or extended.

Embodiment 3: A method comprising: disposing, into a wellbore, a drill string that includes a drill bit having a nozzle, wherein the nozzle includes a variable diameter outlet orifice; drilling the wellbore with the drill bit of the drill string; discharging, during the drilling, fluid through the variable diameter outlet orifice of the nozzle received from the surface and through the drill string; detecting a value of at least one of a drilling metric of the drilling and a downhole condition of the wellbore; and in response to determining that the value of the at least one of the drilling metric and the downhole condition has exceeded a threshold, adjusting a diameter of the variable diameter outlet orifice to adjust at least one of a pressure and an exit velocity of fluid discharged from the variable diameter outlet orifice. For Embodiment 3, the nozzle may be incorporated in a nozzle assembly that comprises a nozzle body having a plurality of movable closure elements that forms an inlet orifice and a variable diameter outlet orifice, and wherein said nozzle assembly further includes an actuator configured to vary a diameter of the variable diameter outlet orifice based on a change of position of the plurality of movable closure elements. For Embodiment 3, the plurality of movable closure elements may comprise a plurality of slats each having a first end and a second end, each slat contoured to overlap with lengthwise edges of adjacent slats, wherein each first end is rotationally attached at a respective position around the inlet orifice, and wherein the second ends form the variable diameter outlet orifice, wherein the actuator includes a ring member disposed circumferentially around the plurality of slats, and wherein said adjusting a diameter of the variable diameter outlet orifice comprises linearly displacing the ring member between the first end and the second end of the plurality of slats.

What is claimed is:

1. A drill bit nozzle comprising:

a nozzle body including, a fixed diameter inlet orifice; and a plurality of slats each having a first end, a second end, and a pair of lengthwise edges extending between the first end and the second end, each slat contoured to overlap with lengthwise edges of one or more adjacent slats, wherein each first end is rotationally attached at a respective position around the inlet orifice, and wherein the second ends form the variable diameter outlet orifice, wherein each slat comprises a radially outward facing surface that is ramped upwardly from the second end to the first end or upwardly from the first end to the second end;

a ring member disposed circumferentially around said plurality of slats; and an actuator configured to linearly displace said ring member lengthwise along said plurality of slats.

2. The drill bit nozzle of claim 1, wherein the radially outward facing surface ramps upwardly from the second end to the first end such that said ring member imparts greater deflection on said plurality of slats as said ring member is linearly displaced away from the second end to the first end.

3. The drill bit nozzle of claim 1, wherein the pair of lengthwise edges comprise beveled edges.

4. The drill bit nozzle of claim 1, wherein each of the slats comprises a trapezoidal contoured member in which the first end is wider than the second end.

5. The drill bit nozzle of claim 1, wherein said actuator comprises an electromechanical actuator configured to linearly displace said ring member along positions between the inlet orifice and the variable diameter outlet orifice.

6. The drill bit nozzle of claim 5, wherein said actuator comprises a motor and actuator arm, wherein the actuator arm is coupled to said ring member and wherein the motor is configured to linearly displace the actuator arm.

7. The drill bit nozzle of claim 1, wherein the radially outward facing surface ramps upwardly from the first end to the second end such that said ring member imparts greater deflection on said plurality of slats as said ring member is linearly displaced away from the first end to the second end.

8. A drill bit assembly comprising:

a body member having at least one fluid port;

a bit face supported by said body member and including one or more cutter elements;

one or more nozzle assemblies disposed within said bit face and configured to discharge fluid received from the at least one fluid port, wherein each of said one or more nozzle assemblies includes a fixed diameter nozzle inlet and a variable diameter nozzle outlet, wherein each of said one or more nozzle assemblies comprises, a plurality of slats each rotatably attached at a proximal end around a perimeter of the fixed diameter nozzle inlet, wherein distal ends of the plurality of slats form the variable diameter nozzle outlet, wherein each slat includes a radially outward facing surface that ramps upwardly from the distal end to the proximal end; and a ring member disposed circumferentially around the plurality of closure elements; and an actuator configured to linearly displace said ring member along positions between the fixed diameter inlet and the variable diameter outlet.

9. A drill bit nozzle comprising:

a nozzle body having a plurality of slats circumferentially arranged to form an inlet orifice, a variable diameter outlet orifice, and a fluid a passage to transport fluid from the inlet orifice to the variable diameter outlet orifice, wherein said plurality of slats each includes a first end, a second end, and a pair of lengthwise edges extending between the first end and the second end, each slat contoured to overlap with lengthwise edges of one or more adjacent slats, wherein each first end is rotationally attached at a respective position around the inlet orifice, and wherein the second ends form the variable diameter outlet orifice;

a ring member disposed circumferentially around the plurality of slats; and an actuator configured to vary a diameter of the variable diameter outlet orifice by changing position of the ring member.

10. The drill bit nozzle of claim 9, wherein said actuator comprises a motor and actuator arm, wherein the actuator arm is coupled to said ring member and wherein the motor is configured to linearly displace the actuator arm.

11. The drill bit nozzle of claim 9, wherein the pair of lengthwise edges comprise beveled edges.

12. The drill bit nozzle of claim 9, wherein each of the slats comprises a trapezoidal contoured member in which the first end is wider than the second end.

13. The drill bit nozzle of claim 9, wherein each of the slats comprises a radially outward facing surface that is ramped upwardly from the second end to the first end or upwardly from the first end to the second end.

14. The drill bit nozzle of claim 13, wherein the radially outward facing surface ramps upwardly from the second end to the first end such that said ring member imparts greater deflection on said plurality of slats as said ring member is linearly displaced away from the second end to the first end.

15. The drill bit nozzle of claim 13, wherein the radially outward facing surface ramps upwardly from the first end to the second end such that said ring member imparts greater deflection on said plurality of slats as said ring member is linearly displaced away from the first end to the second end.

16. A drill bit assembly comprising:

a body member having at least one fluid port;

a bit face supported by said body member and including one or more cutter elements; and one or more nozzle assemblies disposed within said bit face and configured to discharge fluid received from the at least one fluid port, wherein each of said one or more nozzle assemblies includes a fixed diameter nozzle inlet and a variable diameter nozzle outlet, wherein each of said one or more nozzle assemblies comprises an inner frustum-contoured body member disposed within an outer frustum-contoured body member, wherein the inner frustum-contoured body member and the outer frustum-contoured body member have a plurality of discharge slots formed therein.

17. The drill bit assembly of claim 16, wherein each of said one or more nozzle assemblies includes a rotational actuator comprising:

an actuator arm extending outwardly from the inner frustum-contoured body member into an actuator slot formed within the outer frustum-contoured body; and a spring disposed within the actuator slot and configured to apply a force to the actuator arm when the spring is compressed or extended.

18. The drill bit assembly of claim 17, wherein the discharge slots of the inner frustum-contoured body are aligned with the discharge slots of the outer frustum-contoured body when the actuator arm is positioned within the actuator slot such that the spring is compressed or extended.

* * * * *